US006401505B1

(12) United States Patent
Kajuch et al.

(10) Patent No.: US 6,401,505 B1
(45) Date of Patent: Jun. 11, 2002

(54) LOCKER LOCK

(75) Inventors: Pete Kajuch, Brookfield; Glenn Meekma, Menomonee Falls, both of WI (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 09/549,542

(22) Filed: Apr. 14, 2000

(51) Int. Cl.[7] ..... E05B 37/00; E05C 9/00
(52) U.S. Cl. ..... 70/301; 292/163
(58) Field of Search ..... 70/301; 292/137, 292/163, 170, 2, 10

(56) References Cited

U.S. PATENT DOCUMENTS

| | | | | |
|---|---|---|---|---|
| 3,572,063 | A | 3/1971 | Foote | 70/50 |
| 3,586,163 | A | 6/1971 | Loehrer et al. | 206/80 R |
| 3,598,931 | A | 8/1971 | Foote | 179/189 |
| 3,635,057 | A | 1/1972 | Foot et al. | 70/424 |
| 3,664,163 | A | 5/1972 | Foote | 70/58 |
| 3,667,260 | A | 6/1972 | Foote | 70/159 |
| 3,943,738 | A | 3/1976 | Foote | 70/232 |
| 3,977,221 | A | 8/1976 | Foote | 70/58 |
| 3,983,724 | A | 10/1976 | Foote | 70/25 |
| 4,047,406 | A | 9/1977 | Foote | 70/25 |
| 4,432,162 | A | 2/1984 | Foote | 49/55 |
| 4,487,134 | A | 12/1984 | Foote | 108/44 |
| 5,501,492 | A | 3/1996 | Kajuch | 292/1.5 |
| 5,516,160 | A | 5/1996 | Kajuch | 292/1.5 |
| 5,647,617 | A | 7/1997 | Kajuch | 292/1.5 |
| 5,713,612 | A | 2/1998 | Kajuch | 292/36 |
| 5,918,916 | A | 7/1999 | Kajuch | 292/163 |

*Primary Examiner*—Yonel Beaulieu
(74) *Attorney, Agent, or Firm*—Calfee, Halter & Griswold LLP

(57) ABSTRACT

A combination locker lock is provided having a three digit combination that can be set by a key to one of six different combinations. The locker lock includes a bolt that can retract into the case of the lock, fully extended from the case to function as a dead bolt, and partially extended from the case to function as a spring loaded automatic bolt. A plunger associated with the bolt is used to release the bolt from the partially to the fully extended position, and a single trigger associated with the bolt is used to hold the bolt in the partially extended position and the fully extended position.

17 Claims, 20 Drawing Sheets

LOCKER LOCK

BACKGROUND OF THE INVENTION

The lockers typically used in athletic locker rooms and schools include a door that is hinged on either the right or left side and that includes a latch and/or lock mechanism. The door is made of a sheet of metal that is either solid or mesh. The door is secured in the closed position by the latch mechanism and lock. In many lockers, a combination lock is used, and the latch mechanism and the lock are combined into a single mechanism. In these lockers, the door is held in the closed position by an extensible bolt that engages behind a strike in the frame of the locker.

In general, there are two types of bolts, automatic spring loaded bolts and manual dead bolts. Gym and school lockers usually contain a spring loaded bolt. A spring loaded bolt, when in an extended position, can be forced back into the lock case from which it extends simply by pushing on the end of the bolt. This type of bolt has a tapered side so that when the door is pushed closed the tapered side hits against the strike in the door, pushing the bolt into the lock case. When the bolt clears the strike, it once again extends. A straight surface of the bolt opposite the tapered surface engages the area behind the strike such that the door can only be opened upon rotation of the internal mechanism of the lock upon proper sequencing of the combination. Therefore, a locker having a spring loaded bolt provides the benefit of being able to close the door without first pulling the bolt into the case. The spring loaded bolt also contributes to one of the drawbacks of these lockers. Even when the door is closed and the bolt is disposed behind the strike, if one can access the bolt and push on it, the bolt will move into the housing, defeating the lock. Lockers with mesh type doors are particularly susceptible to this type of attack.

By contrast, when a deadlocked bolt is in the extended position, it cannot be pushed back into the housing by means of an applied external force. The bolt is said to be dead, hence the name dead bolt. This type of bolt solves the drawback of the spring loaded bolt being defeated by an applied external force even with the door closed. However, a locker having a dead bolt type lock cannot simply be pushed closed with the bolt in the extended position. The bolt must first be retracted by use of the combination mechanism and sometimes extended by using the combination mechanism again once the door is closed. This makes opening and closing the locker quite cumbersome.

Attempts have been made to combine the benefits of both of these bolt types in latches used in conventional entry way doors. For example, U.S. Pat. No. 5,516,160 is directed to automatic deadbolts. This patent discloses a lock having a bolt cooperating with a wire the end of which is disposed in a complex series of slots, ramps, and walls within the side of the bolt. A plastic clip retains the end of the wire in operative contact with the bolt. The bolt can be positioned in an inserted position, fully extended dead bolt position, or an intermediately extended automatic bolt position based upon the path of the end of the wire through the slots, ramps, and walls. As such, only the bolt itself is needed to direct movement from the intermediate position to the fully extended position. Separate mechanisms within the lock, however, are needed to position the bolt in the inserted position and to secure the bolt in the fully extended position.

U.S. Pat. No. 5,918,916 is directed to an automatic deadbolt having a separate plunger. This patent discloses a lock in which the bolt automatically extends to its full deadlocking position when the door is closed. According to this patent, a plunger mechanism is included and placed on top of the bolt such that contact between the plunger and the door strike has the effect of automatically moving the bolt to its fully extended position. The bolt also includes a pair of stop members pivotally attached thereto. The stop members each have a pin that engages one of two cam tracks in the plunger and co-acts with the plunger such that relative movement between the plunger and the bolt causes the stop members to pivot between extended and retracted positions. In the extended position, the stop members engage stakes on each side of a front case of the lock to prevent outward movement of the bolt beyond the intermediate extended position. In the retracted position, the bolt cannot be held by the stakes and is permitted to move to its fully extended position. Inward movement of the plunger is limited by contact with the front plate of the lock. Outward movement of the plunger is limited by either contact between the bottom projection of the plunger and the front wall of a track in the top of the bolt or contact between the plunger and the door strike. Like the device of the previously mentioned patent, separate mechanisms within the lock are needed to position the bolt in the inserted position and to secure the lock in the fully extended position.

In addition, the automatic bolt combination locks used on lockers are supplied with one factory combination and four addition combinations for a total of five combinations. By inserting a key into the combination dial and rotating while at the same time pushing a button extending from the back case of the lock, the current combination setting can be moved sequentially through the four alternative combinations. Should an object within the locker fall against the button, then the combination lock could fail to operate properly. In addition, the sheet-like metal of the door is significantly thinner than the lock case causing it to protrude from the inside surface of the door. Given that many gym and school lockers have narrow doors and correspondingly short pivot radiuses, the lock case can contact the strike if not positioned back from the edge of the door. However, moving the lock away from the door edge also decreases the length of bolt that overlaps the door frame behind the strike, because the bolt is also moved inward from the edge of the door. This problem increases as the door width decreases and with locker doors having recessed pockets in which the combination locks are disposed.

SUMMARY OF THE INVENTION

In accordance with the present invention, a combination locker lock for mounting to the door of a storage locker is provided. The lock has a case and a bolt extending therefrom for engaging behind a strike in the locker frame. This bolt acts both as a spring loaded bolt and a dead bolt. To accomplish this dual functionality, the bolt has two extension positions, a fully extended position where the bolt acts like a dead bolt and a partially extended position where the bolt acts like a spring loaded bolt. The bolt can only be moved inward from its fully extended position upon entering the proper combination and rotating the combination dial. The two extension positions also enable greater bolt extension from the lock without requiring increased bolt thickness in order to accommodate a full-face taper.

When the bolt is in the partially extended position and the locker door is closed, the strike will push against a tapered surface on the bolt, pushing in the bolt into the case. A plunger associated with the bolt will also be pushed into the case. When the bolt passes the strike it will begin to extend from the case; however, the plunger, because of its positioning relative to the bolt, will contact the strike and will not extend from the case with the bolt. This induces relative motion between the plunger and the bolt, which permits the bolt to move to the fully extended position. A single trigger mechanism associated with the bolt and the plunger is used to hold the bolt in the spring loaded position, to secure the bolt in the dead bolt position, and to release the bolt to the fully extended position.

The combination lock can be quickly and easily flipped 180° for both right and left hand locker door applications while maintaining the same set of combinations. The lock has a case with integral mounting flanges and a relieved edge adjacent the edge of the door, to permit the combination lock to be placed as close to the strike as possible even in narrow door applications. This maximizes the overlap length of the bolt behind the strike.

The lock has six different combination settings, one factory setting and five changes. The mechanism to change the combination is contained entirely within the lock case. In addition, the lock can be retrofitted onto existing lockers.

DETAILED DESCRIPTION OF THE PREFERRED EMBODIMENT

Figure 1:
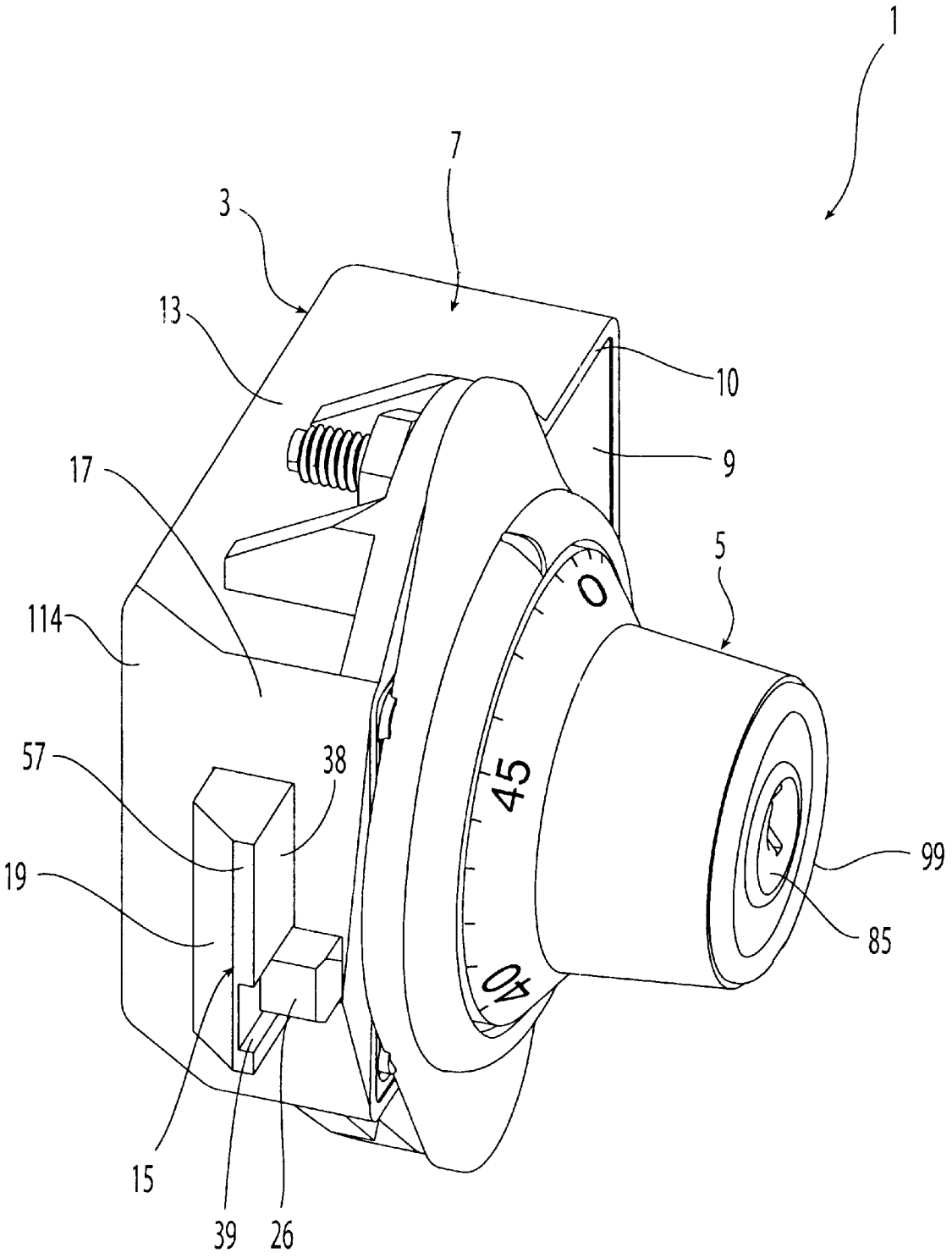
FIG. 1 is a perspective view of a locker lock constructed according to the present invention with the bolt in the fully extended position.

Referring initially to FIGS. 1–5, the combination locker lock 1 of the present invention includes a lock assembly 3 and a dial assembly 5 arranged to be secured to either the right or left edge of a locker door. The lock assembly 3 includes a case 7, a backing plate 8 mounted within the case, and a cover plate 9 mounted on the front 10 of the case 7. The backing plate 8 includes a first side 11 facing the cover plate 9 and a second side 12 facing the back 13 of the case 7. All of the operative elements of the lock assembly 3 are contained between the case 7 and the cover plate 9.

Figure 6:
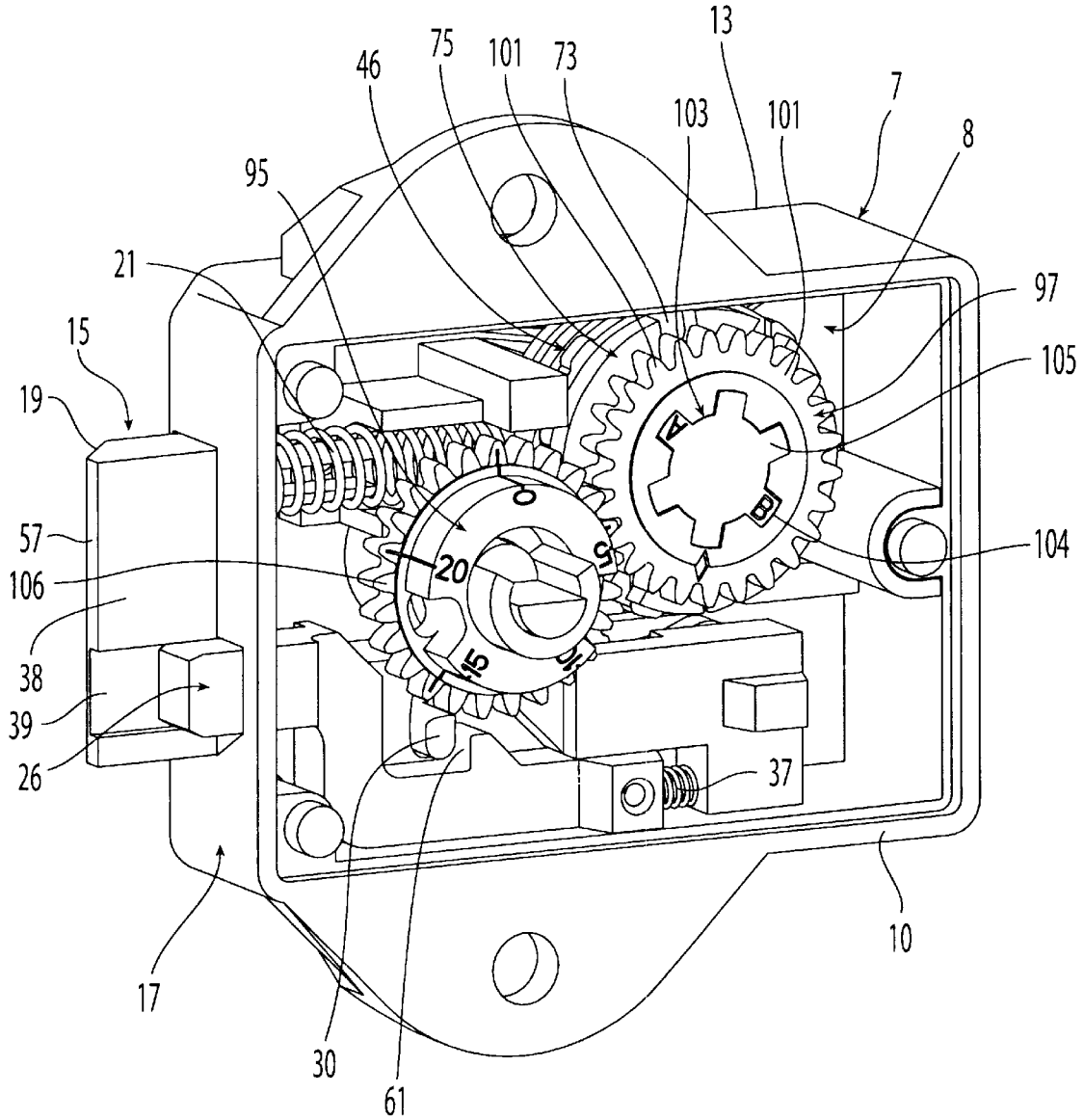
FIG. 6 is a perspective view of the front of the lock assembly portion with the cover plate removed and the bolt in the fully extended position.
Figure 7:
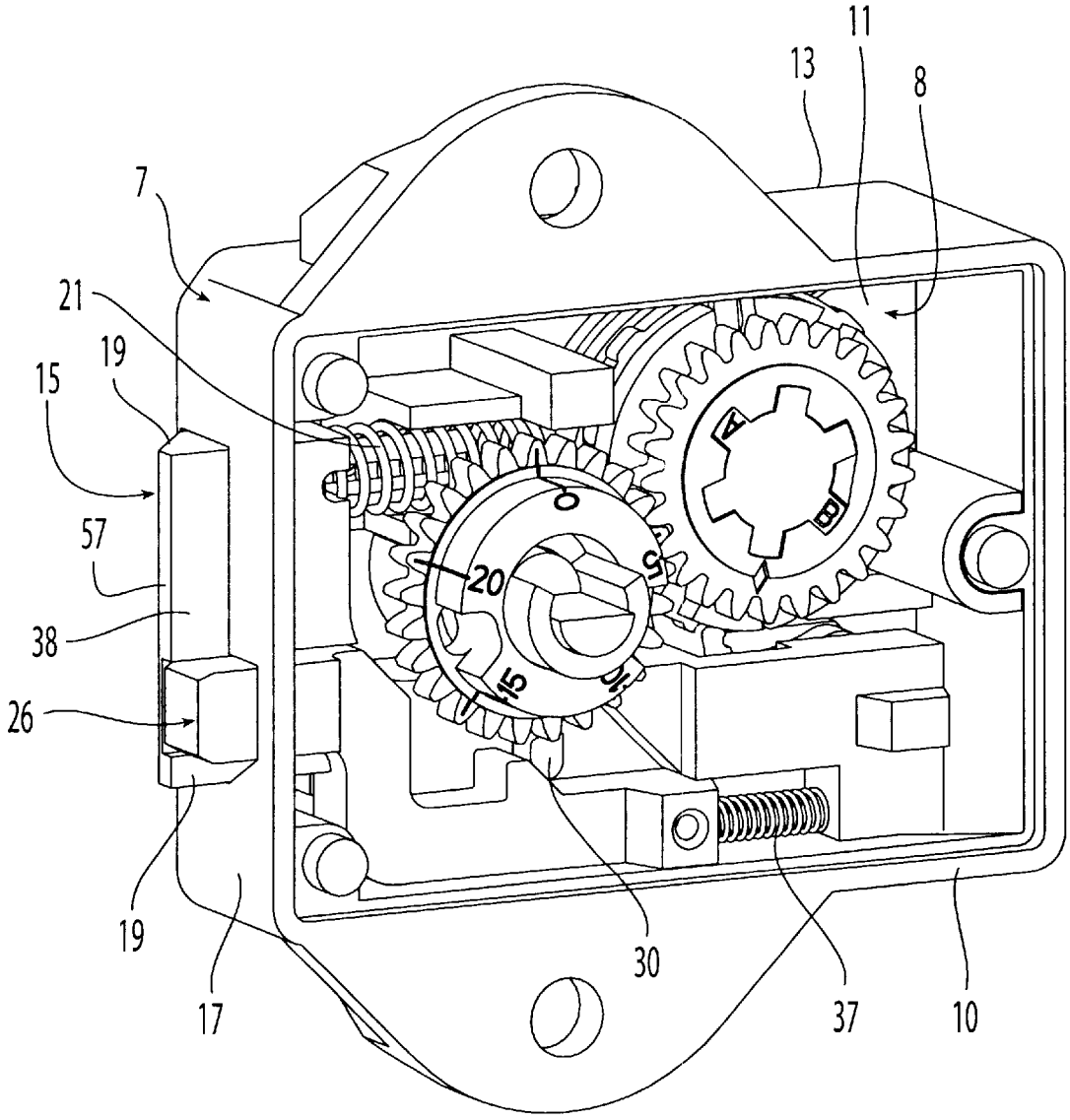
FIG. 7 is a perspective view of the front of the lock assembly with the cover plate removed and the bolt in the partially extended position.

The lock assembly 3 includes a bolt assembly 14 slideably disposed in the case 7 between the first side 11 of the backing plate 8 and the cover plate 9. The bolt assembly 14 includes a bolt 15 that can extend from the case 7 through an opening 16 in a side 17 of the case 7. The bolt 15 has three positions, a retracted position, a fully extended position, and a partially extended position. In the retracted position, the bolt 15 is completely contained within the case 7 and does not extend beyond the opening 16. As is shown in FIGS. 1 and 6, in the fully extended position, the bolt 15 extends a maximum distance through the opening 16. As measured from the side 17 of the case 7, the maximum distance is about ¼ to ⅜ of an inch. When in the extended position, the bolt 15 is a dead bolt and cannot be pushed into the case 7 to the retracted position by an externally applied force. In the partially extended position, the bolt is located between the fully extended position and the retracted position. As is shown in FIG. 7, the bolt 15 extends from the case 7 in the partially extended position just far enough to expose its tapered face 19. The bolt 15 has the properties of a spring loaded, automatic bolt when in the partially extended position. A bolt spring 21, biases the bolt 15 toward the extended positions.

Figure 2:
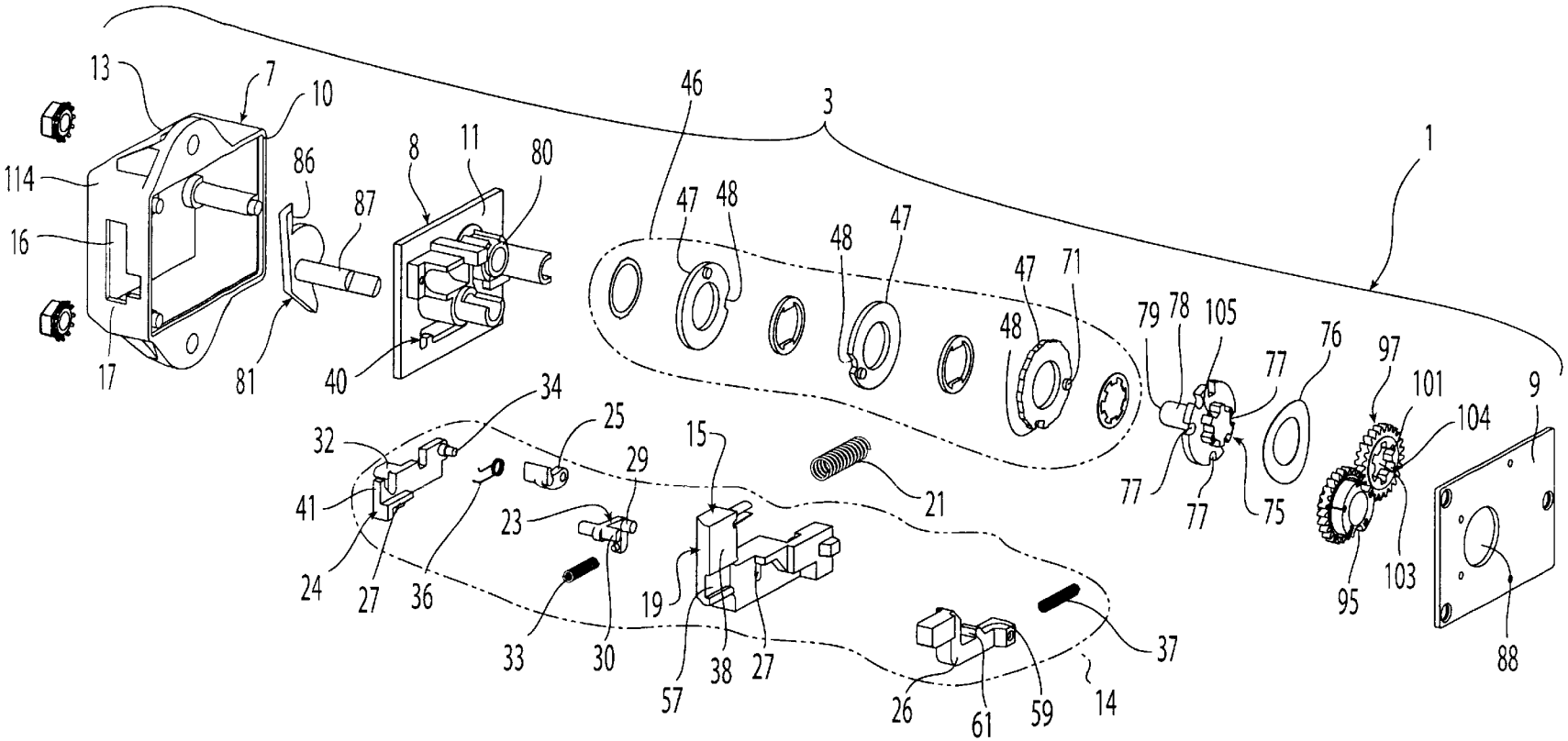
FIG. 2 is an exploded front perspective view of the lock assembly portion of the locker lock arranged for a right hand door installation.
Figure 3:
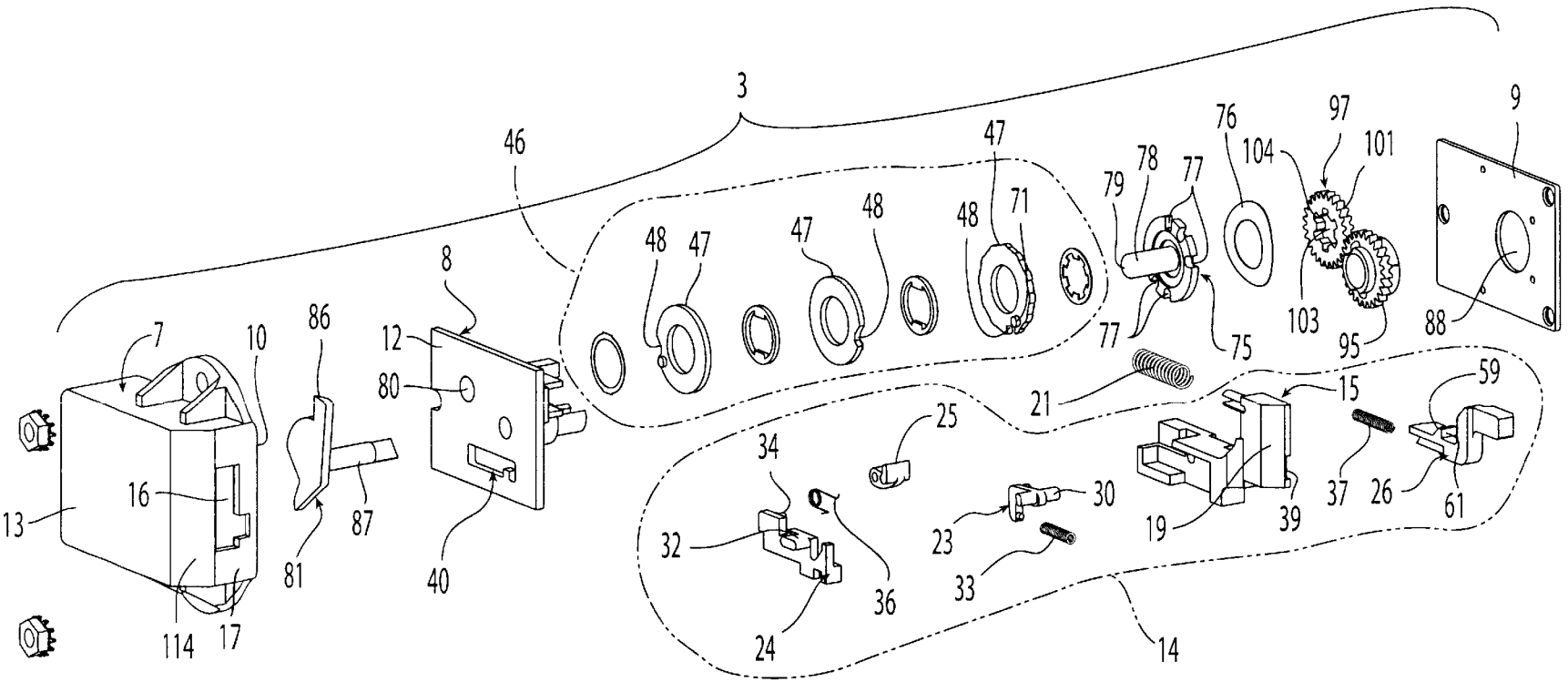
FIG. 3 is an exploded back perspective view of the lock assembly portion.

With respect to the case 7 and backing plate 8, all of the components shown as part of the bolt assembly 14 in FIGS. 2 and 3 move with the bolt 15 as the bolt moves among the three positions. However, movement of the bolt 15 among the three position is made possible by relative movement among the various components that constitute the bolt assembly 14 in particular with respect to the bolt 15. The bolt assembly further includes a trigger 23, slide plate 24, and fence 25 generally disposed between the bolt 15 and the first side 11 of the backing plate 8 and a plunger 26 disposed between the bolt 15 and the cover plate 9.

Figure 8:
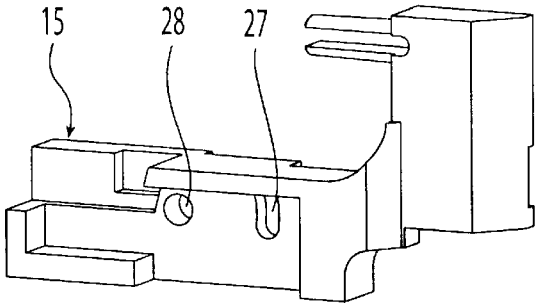
FIG. 8 is a perspective view of the back of the bolt.
Figure 9:
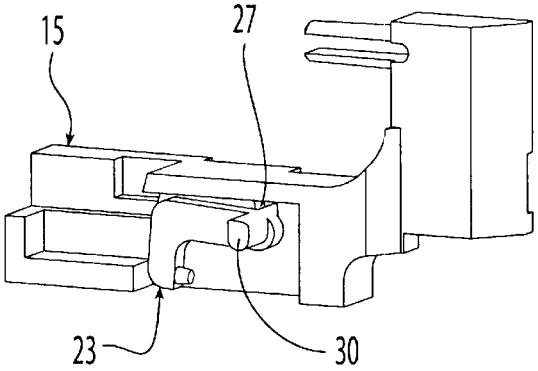
FIG. 9 is a perspective view of the back of the bolt with the trigger attached to the bolt.

Referring first to the components of the bolt assembly 14 located between the bolt 15 and the first side 11 of the backing plate 8, FIG. 8 is a perspective view from the same side as FIG. 3 of only the bolt 15. This is the side of the bolt that faces the first side 11 of the backing plate 8. As is shown in FIG. 8, the bolt 15 includes an elongated passage 27 passing through the bolt 15 and a circular hole 28. The trigger 23 is pivotally attached to this side of the bolt 15 as shown in FIG. 9 by inserting a circular post 29 (FIG. 2) extending from the trigger 23 into the circular hole 28. The trigger 23 includes a cross member 30 arranged perpendicular to the plane in which the trigger 23 pivots and extending through the elongated passage 27. The elongated passage 27 permits vertical movement of the cross member 30 portion of the trigger 23 with respect to the bolt 15; however, movement of the bolt 15 relative to the trigger 23 towards either the extended positions or the retracted position is prevented.

Figure 10:
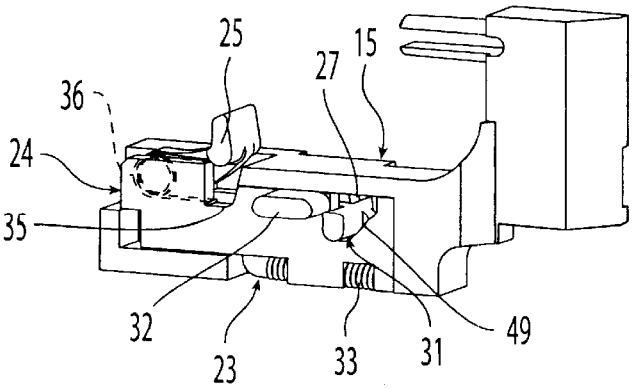
FIG. 10 shows the bolt of FIG. 9 with the slide plate and fence attached to the bolt and in one position of operation.
Figure 11:
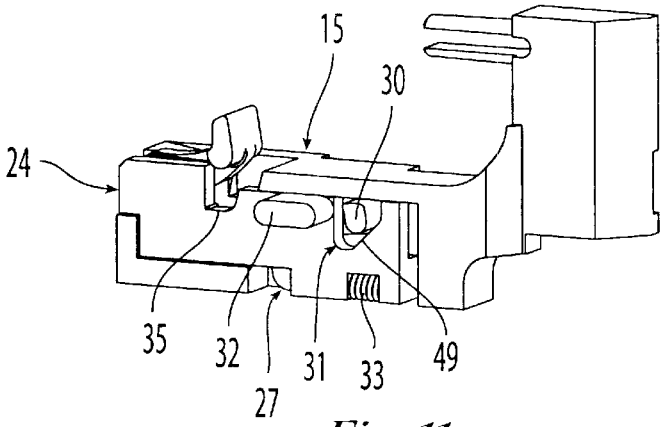
FIG. 11 shows the bolt of FIG. 10 in another position of operation.

As is shown in FIGS. 10 and 11, the slide plate 24 is disposed on the same side of the bolt 15 such that the trigger 23, other than the cross member portion 30, is located between the bolt 15 and the slide plate 24. The cross member portion 30 extends completely through a trough 31 in the slide plate 24 and protrudes from the side of the slide plate 24 opposite the bolt 15. Also protruding from and fixed to this side of the slide plate 24 is an arm 32. The slide plate 24 is capable of movement relative to the bolt 15 between a forward position, which is shown in FIG. 10, and a rearward position, which is shown in FIG. 11. A slide plate biasing spring 33 disposed between the slide plate 24 and the trigger 23 biases the slide plate 24 toward the forward position and biases the cross member 30 of the trigger 23 into engagement with the bottom of the trough 31.

Figure 12:
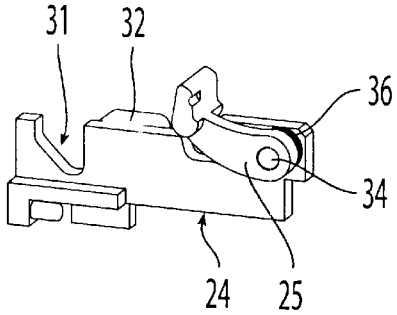
FIG. 12 is an opposite side perspective view of the slide plate and fence.

FIG. 12 provides a perspective view of the side of the slide plate 24 hidden from view in FIGS. 10 and 11 that faces the bolt 15. From the view of FIG. 12, it can be seen that the fence 25 is pivotally mounted on a spindle 34 extending from the slide plate 24 and is not otherwise attached to the bolt 15. Therefore, the fence 25 moves with the slide 24 relative to the bolt 15. Although a cut-out 35 is provided in the slide plate 24 to accommodate the fence 25, a torsion spring 36 mounted on the spindle 34 between the fence 25 and the slide plate 24, as is shown in FIG. 10, biases the fence 25 upward and out of engagement with the cut-out 35.

Figure 13:
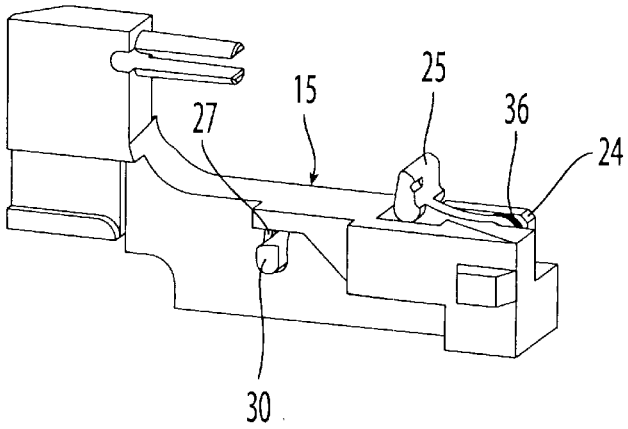
FIG. 13 is a perspective view of the bolt of FIG. 10 from the opposite side of the bolt.
Figure 14:
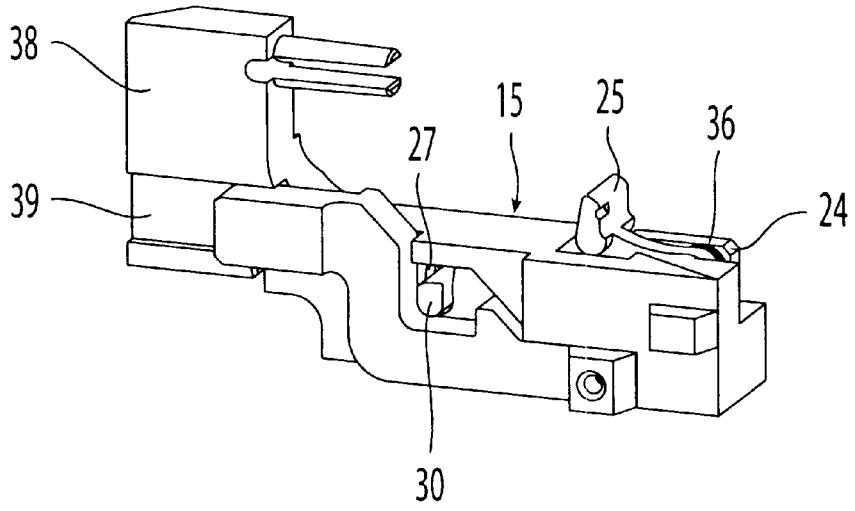
FIG. 14 is the perspective view of the bolt of FIG. 13 with the plunger attached to the bolt in one position of operation.
Figure 15:
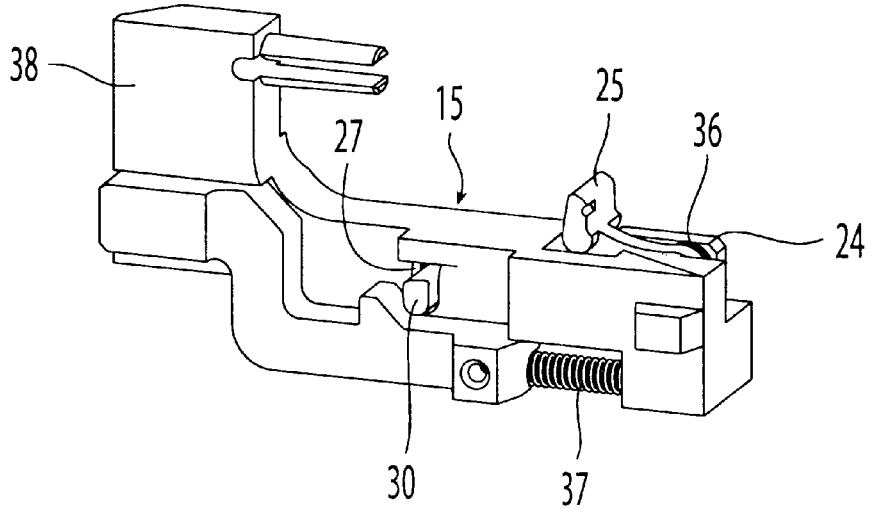
FIG. 15 is the perspective view of the bolt of FIG. 14 in another position of operation.

FIG. 13 is the perspective view of FIG. 10 from the opposite side of the bolt 15, which is the perspective view corresponding to FIG. 2. In FIG. 13, the cross member 30 of the trigger 23 is shown emerging from the elongated passage 27 and extending from this side of the bolt 15. The plunger 26 is disposed on this side of the bolt 15 and can slide relative to the bolt 15 between an inward position, as shown in FIG. 14, and an outward position, as shown in FIG. 15. A plunger spring 37 is disposed between the plunger 26 and the bolt 15 and biases the plunger 26 toward the outward position. As is shown in FIGS. 1, 6, and 7, the plunger 26 extends from the case 7 through the opening 16 and along a flat face 38 of the bolt 15. A groove 39 is provided in the flat face 38 to guide the plunger 26 as it moves between the inward and outward positions.

Figure 16:
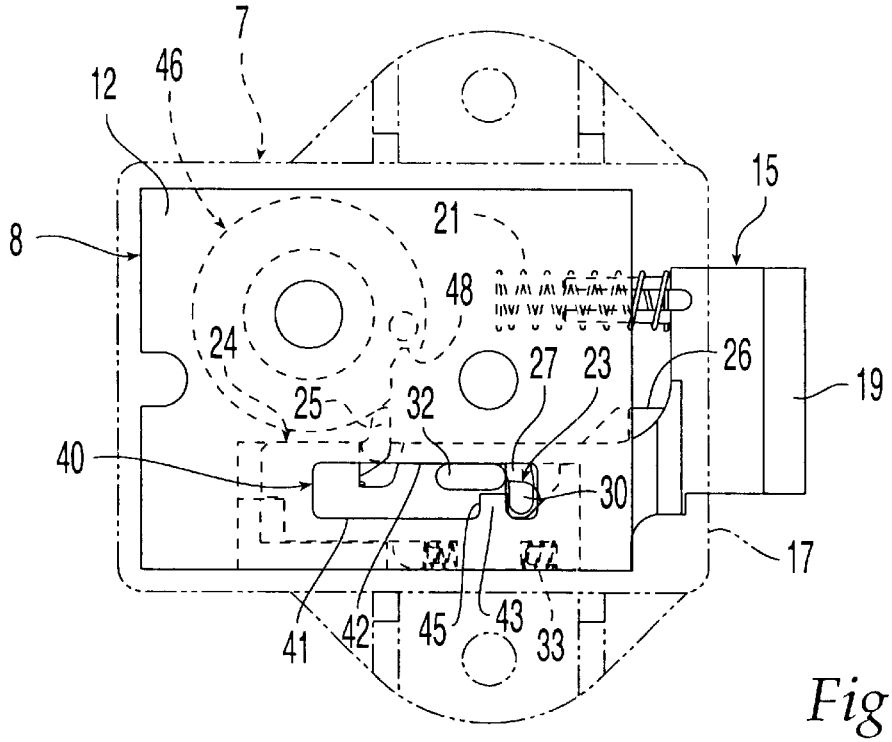
FIG. 16 is a side view of one side of the backing plate portion of the lock assembly with the parts of the assembly in a first position of operation.
Figure 17:
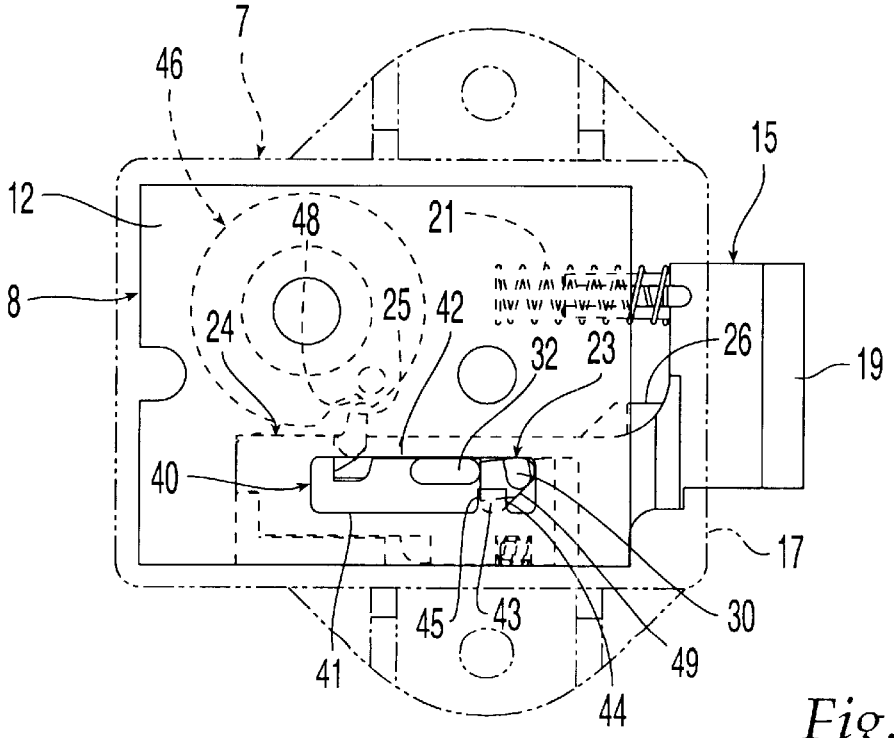
FIG. 17 is a side view of one side of the backing plate portion of the lock assembly with the parts of the assembly in a second position of operation.

FIGS. 16–17 are views of the second side 12 of the backing plate in the general direction of FIG. 3 with the bolt assembly 14 and the bolt spring 21 positioned adjacent the first side 11 of the backing plate 8. These views illustrate the relative motion among the components of the bolt assembly 14 positioned between the bolt 15 and the first side 11 of the backing plate 8 as the bolt 15 moves from the fully extended position, through the retracted position, to the partially extended position. Those portions of the bolt assembly 14 located behind the backing plate 8 are shown in dashed lines. In addition, the location of the case 7 with respect to the bolt 15 is also shown in dashed lines for reference.

The backing plate 8 includes an elongated slot 40 passing from the first side 11 to the second side 12. The slot 40 includes a first bottom side 41 and a second top side 42. A stop 43 extends partially into the slot 40 from the first side 41. The stop 43 includes a front surface 44 and a back surface 45 opposite the front surface 44. Both the cross member 30 portion of the trigger 23 and the arm 32 attached to the slide plate 24 extend into the slot 40 with the arm 32 located adjacent to second side 42 of the slot 40. In FIG. 16, the bolt 15 is in the fully extended position, and the slide plate 24 is located in the forward position with respect to the bolt 15. The cross member 30 is biased into engagement with both the bottom of the trough 31 in the slide plate 24 and the first side 41 of the slot 40. In addition, the cross member 30 is in contact with the front surface 44 of the stop 43. This contact between the cross member 30 and the front surface 44 prevents movement of the bolt 15 from the fully extended position toward the retracted position when an external force is applied to the bolt 15.

A combination wheel pack 46 is rotatably attached to the first side 11 of the backing plate 8. As is shown in FIGS. 2 and 3, the wheel pack includes a plurality of concentric wheels 47 that are rotatable with respect to each other. Each wheel includes a notch 48, and the notches 48 move into alignment axially along the wheel pack 46 when the proper combination is entered into the lock 1. Such combination wheel packs having notches are known in the art. As is shown in FIG. 16, the fence 25 is biased into engagement with the wheel pack 46. As is shown in FIG. 17, the fence 25 engages into the aligned notches 48, and continued rotation of the wheel pack 46 produces a force pulling the bolt assembly 14 toward the retracted position. Since the fence 25 is attached to the slide plate 24 and the slide plate 24 is capable of motion relative to the bolt 15, this pulling force will first move the slide plate 24 from the forward to the rearward position. This relative motion causes the cross member 30 of the trigger 23 to engage a slide plate cam surface 49, lifting the cross member 30 away from the bottom side 41 of the slot 40 and toward the top side 42 a sufficient distance so that the cross member moves out of engagement with the front surface 44 of the stop 43.

Figure 18:
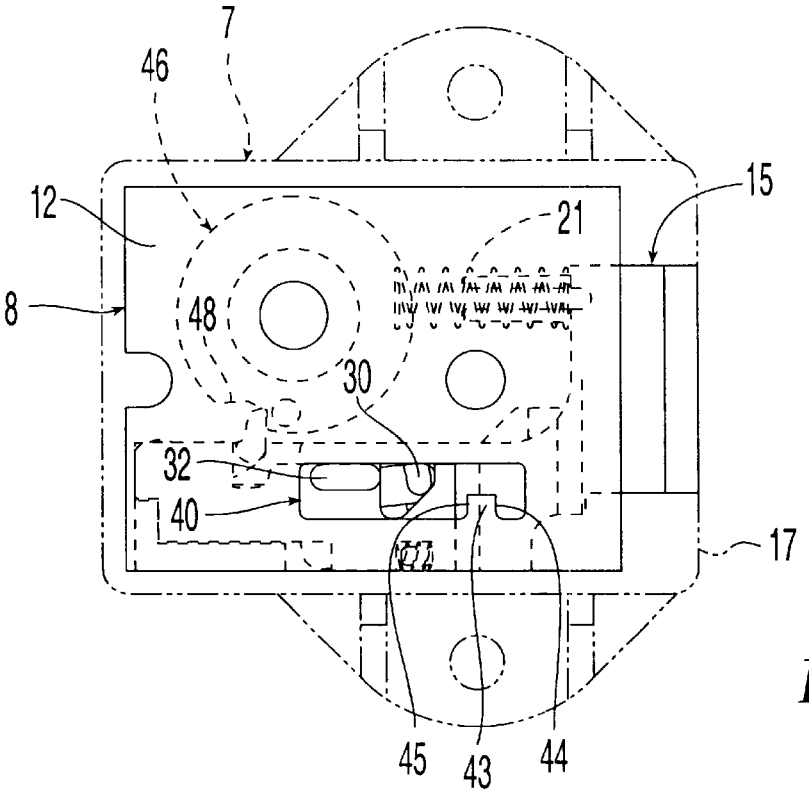
FIG. 18 is a side view of one side of the backing plate portion of the lock assembly with the parts of the assembly in a third position of operation.
Figure 19:
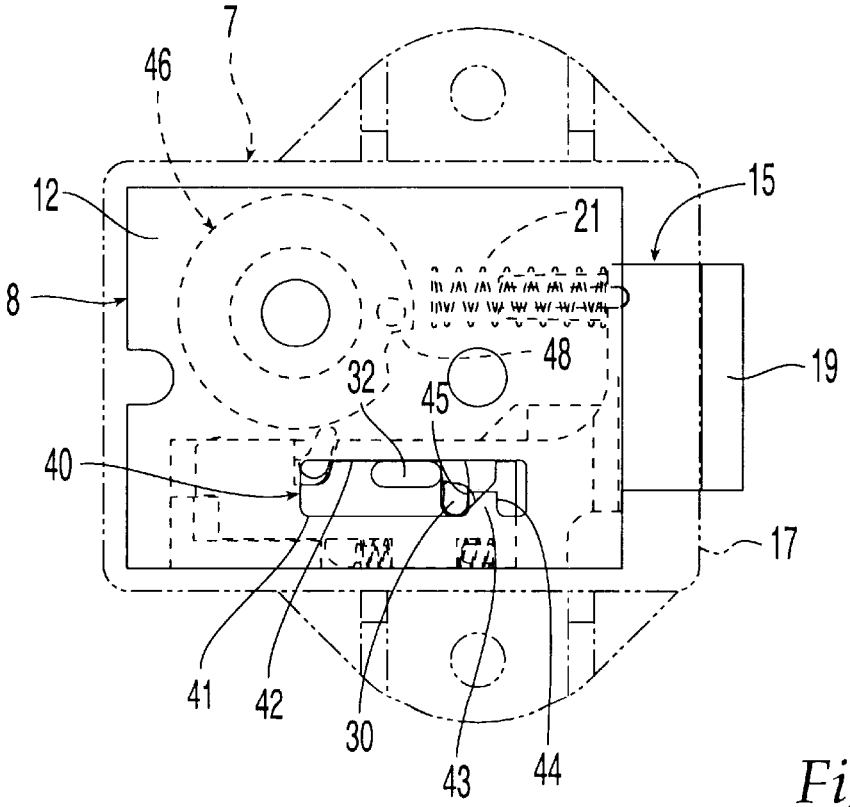
FIG. 19 is a side view of one side of the backing plate portion of the lock assembly with the parts of the assembly in a fourth position of operation.

As is shown in FIG. 18, after the slide plate 24 is in its rearward position, the pulling force moves the bolt 15 to the retracted position. When rotation of the wheel pack 46 is stopped, the pulling force stops, and the bolt assembly 14 will begin to advance toward the extended positions under the force of the spring 21. As is shown in FIG. 19, the slide plate 24 will move relative to the bolt 15 from the rearward to the forward position causing he cross member 30 to move out of engagement with the slide late cam surface 49 and back into engagement with the bottom side 41 of the slot 40. The bolt assembly 14 will continue to move toward the extended positions until the cross member 30 contacts the back surface 45 of the stop 43. The bolt 15 is now in the partially extended position. Contact between the cross member 30 and the back surface 45 prevents the bolt 15 from advancing to the fully extended position; however, the bolt 15 can be pushed to the retracted position by an externally applied force.

FIGS. 20–24 are views of the first side 11 of the backing plate 8 in the general direction of FIG. 2 with the bolt assembly 14 and the bolt spring 21 positioned adjacent the first side 11. These views illustrate the relative motion among the components of the bolt assembly 14 positioned between the bolt 15 and the cover plate 9 as the bolt 15 moves from the partially extended position, through the retracted position, to the fully extended position. In addition, the location of the case 7 with respect to the bolt 15 is also shown in dashed lines for reference.

Figure 20:
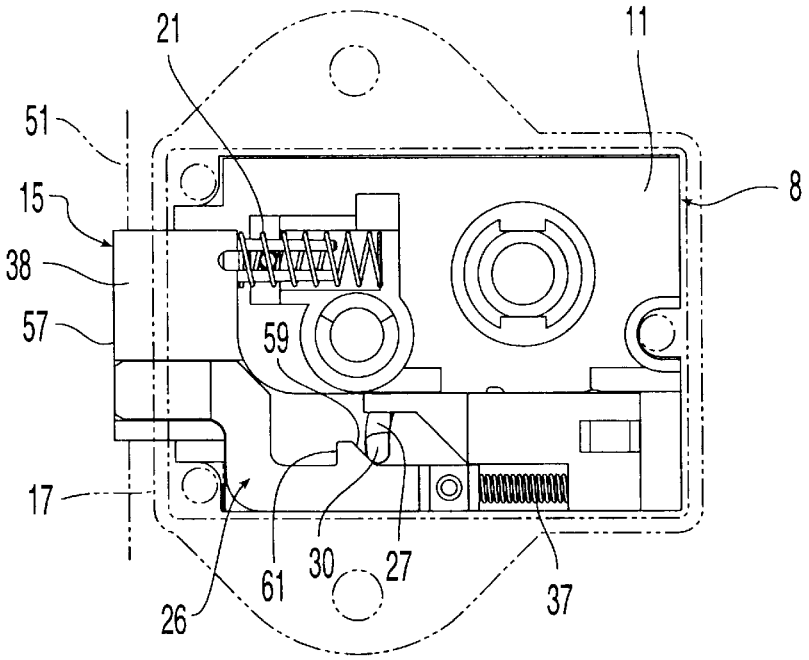
FIG. 20 is a side view of the opposite side of the backing plate portion of the lock assembly with the parts of the assembly in a fifth position of operation.
Figure 21:
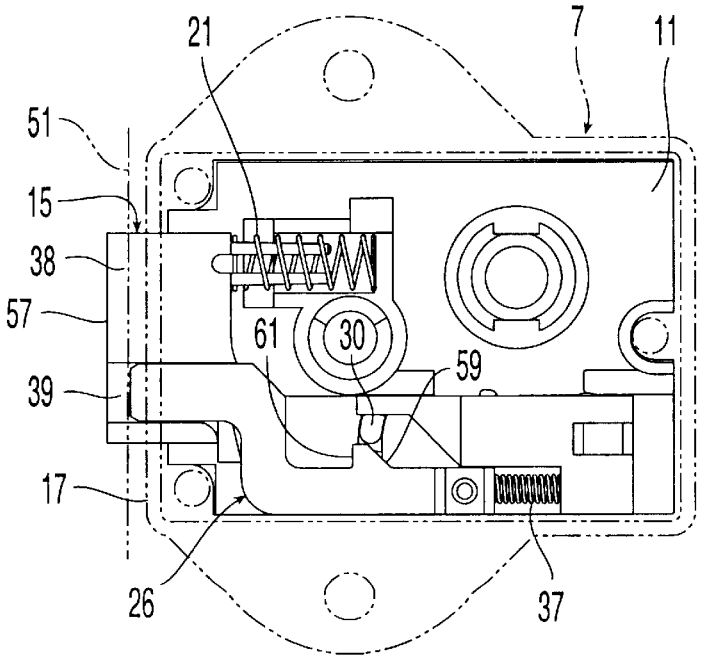
FIG. 21 is a side view of the opposite side of the backing plate portion of the lock assembly with the parts of the assembly in a sixth position of operation.
Figure 22:
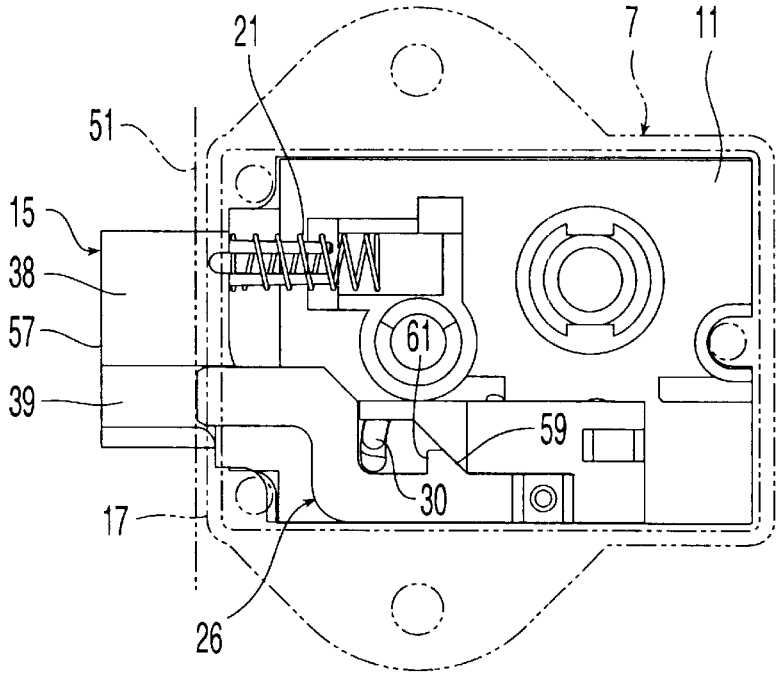
FIG. 22 is a side view of the opposite side of the backing plate portion of the lock assembly with the parts of the assembly in a seventh position of operation.
Figure 23:
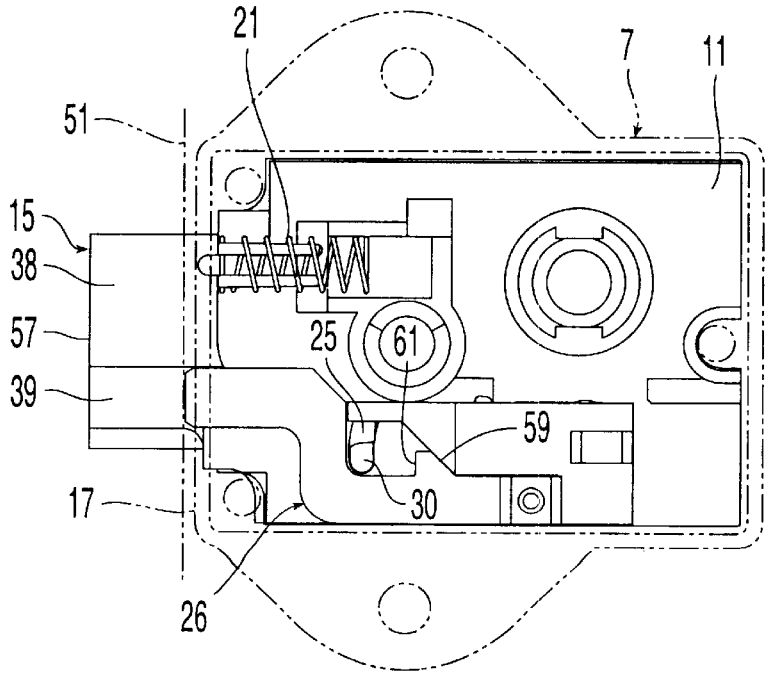
FIG. 23 is a side view of the opposite side of the backing plate portion of the lock assembly with the parts of the assembly in a eighth position of operation.

As shown in FIG. 20, the bolt 15 is in the partially extended position, and the plunger 26 is in the outward position. An external force is applied to the bolt 15 to move it toward the retracted position. When the lock 1 is mounted on a locker door, this external force is applied by contact between the tapered face 19 of the bolt 15 and the door strike 51, represented by a dashed line in FIGS. 20–23. The bolt 15 will continue moving toward the retracted position as the strike 51 advances along the tapered face 19, until the strike 51 passes the leading edge 57 of the bolt 15. As is shown in FIG. 21, the bolt 15 begins to move toward the extended positions carrying the plunger 26 with it; however, the plunger 26 contacts the strike, preventing it from advancing with the bolt 15 and inducing relative motion of the plunger 26 with respect to the bolt toward the inward position. This relative motion causes the cross member 30 to engage a plunger cam surface 59 that lifts the cross member 30 away from the bottom side 41 of the slot 40 a sufficient distance to move the cross member 30 out of engagement with the back surface 45 of the stop 43 (FIG. 18). As is shown in FIG. 22, the bolt 15 can now move to the fully extended position as the plunger 26 moves relative to the bolt 15 to the inward position. The cross member 30 is biased downward, as is shown in FIG. 23, and back into contact with the bottom side 41 of the slot 40 and the front surface 44 of the stop 43 as shown in FIG. 16.

Figure 24:
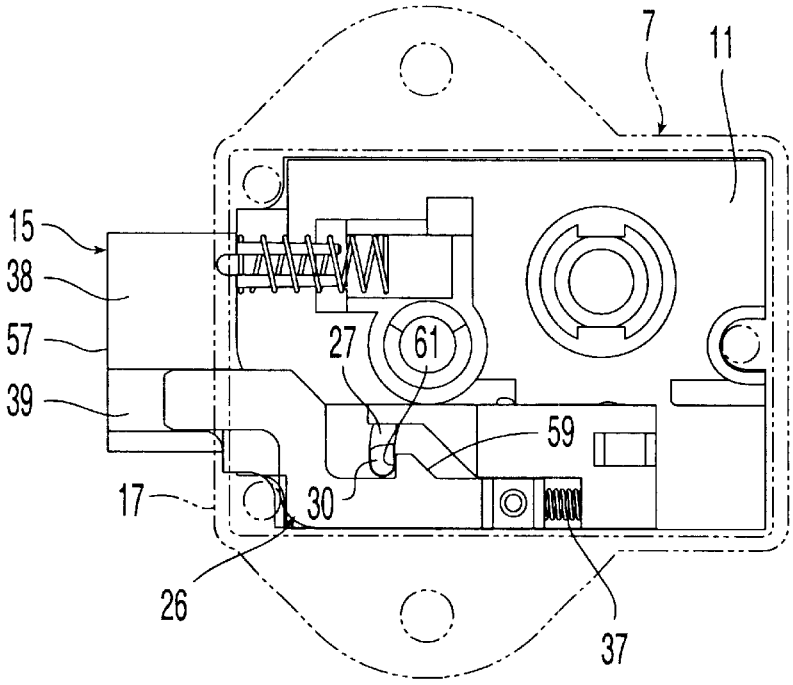
FIG. 24 is a side view of the opposite side of the backing plate portion of the lock assembly with the parts of the assembly in a ninth position of operation.

As is shown in FIG. 24, a plunger stop surface 61 is provided on the plunger 26 adjacent the plunger cam surface 59 in order to retain the plunger in the inward position should the plunger 26 move out of contact with the strike 51. When the slide plate 24 is again pulled toward the rearward position as shown in FIG. 17, the cross member 30 is moved out of engagement with the plunger stop surface 61, permitting the plunger 26 to move relative to the bolt 15 to the outward position shown in FIG. 20 under the force of the expanding plunger spring 37.

As is shown in FIGS. 2 and 3, the combination wheel pack 46 containing the three concentric wheels 47 that are rotatable with respect to each other is rotatably mounted on the first side 11 of the backing plate 8. The three wheels 47 are arranged to define the spacing among the first, second, and third digits in the three digit combination of the locker lock 1 so that the difference between the first and second digits is a constant and the difference between the second and third digits is also a constant. Therefore, assigning a value to any one of the three digits determines the other two digits.

Figure 25:
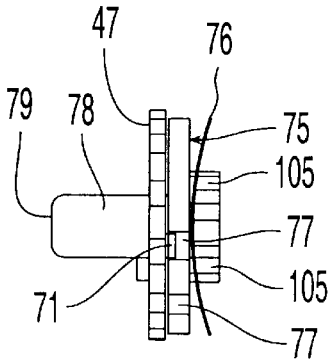
FIG. 25 is a side view of one combination wheel and a change disk of the lock assembly in an engaged position.
Figure 26:
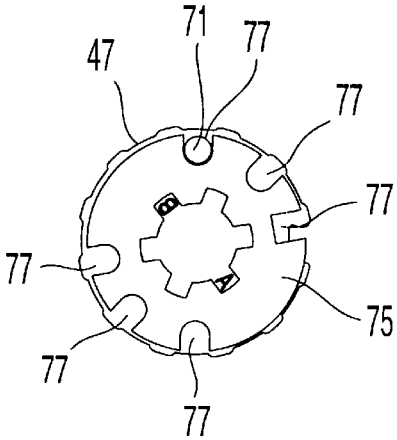
FIG. 26 is an end view of the combination wheel pack and change disk.
Figure 27:
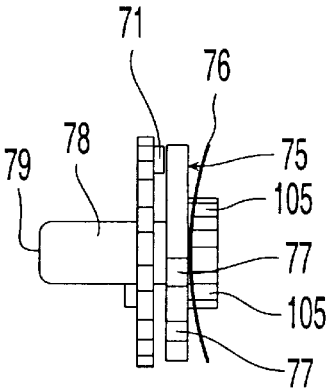
FIG. 27 is a side view of one wheel of one combination wheel pack with the change disk in a disengaged position.

A post 71 extends from one of the wheels 47 in the wheel pack 46, and a change disk 75 is provided adjacent the wheel 47 containing the post between the wheel 47 and the cover plate 9. As is shown in FIGS. 2 and 25, a spring washer 76 is provided between the change disk 75 and the cover plate 9 to bias the change disk 75 into engagement with the wheel 47 containing the post 71 so that one of the six notches 77 in the change disk 75 engages the post 71, preventing rotational motion between the change disk 75 and the wheel 47 containing the post 71. As is shown in FIG. 26, the six notches 77 are arranged in three pairs arranged so that each pair is symmetric about the center of the change disk 75. A shaft 78 extends from the axis of rotation of the change disk 75 and passes axially through the wheel pack 46 and through a hole 80 in the backing plate 8 so that the distal end 79 of the shaft 78 extends from the second side 12 of the backing plate 8. As is shown in FIG. 27, the change disk 75 can be moved away from the wheel 47 containing the post 71.

Figure 28:
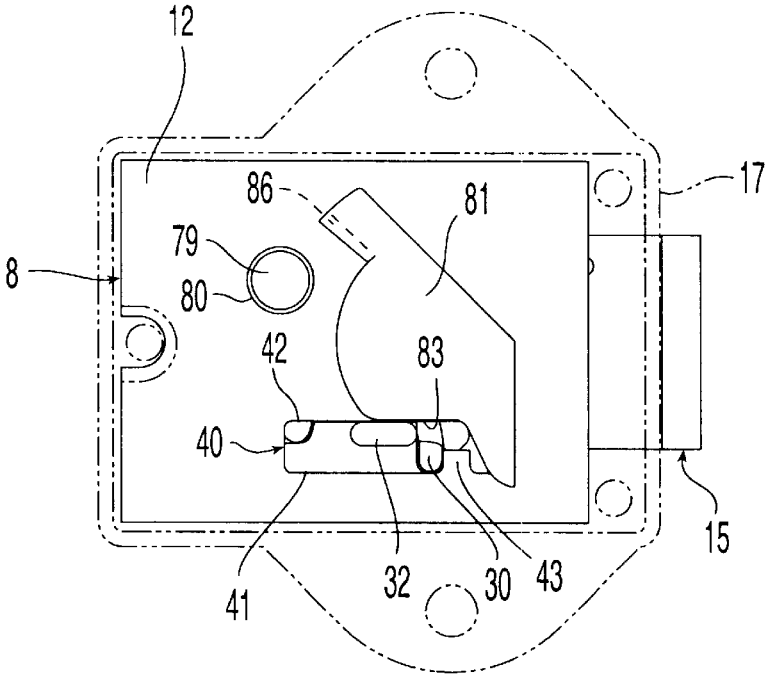
FIG. 28 is a side view of one side of the backing plate portion of the lock assembly with a changing cam attached thereto and the parts of the assembly in a first position of operation.
Figure 29:
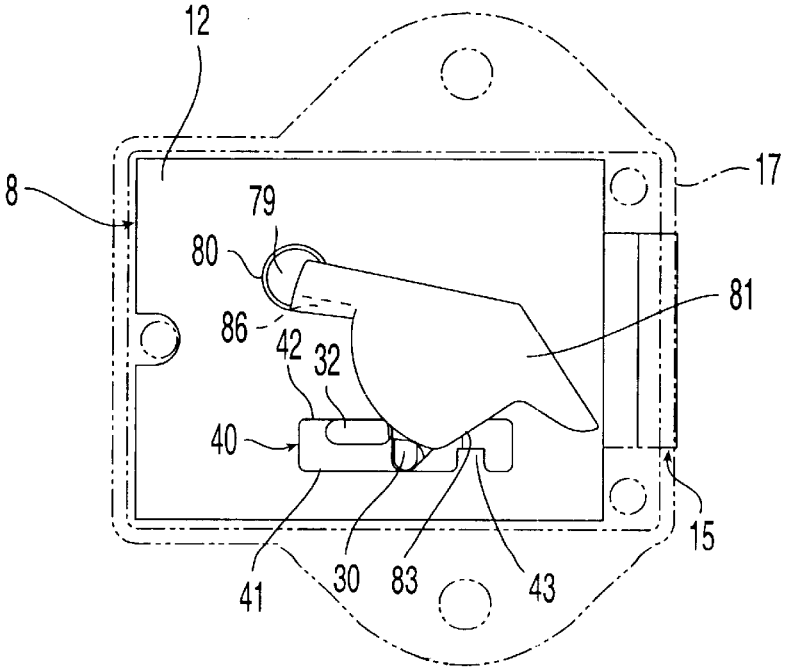
FIG. 29 is a side view of the side of the backing plate portion of the lock assembly with a changing cam attached thereto and the parts of the assembly in a second position of operation.

FIGS. 28 and 29 are views of the second side 12 of the backing plate 8 in the general direction of FIG. 2 with the bolt assembly 14 positioned adjacent the first side 11. In addition, the location of the case 7 with respect to the bolt 15 is also shown in dashed lines for reference. A changing cam 81 is rotationally disposed on the second side 12 of the backing plate 8. As shown in FIG. 28, the bolt 15 is in the partially extended position, and the arm 32 extends through the slot 40 to engage a flat area 83 on the changing cam 81 to prevent rotation of the changing cam 81 with respect to the backing plate 8.

Figure 4:
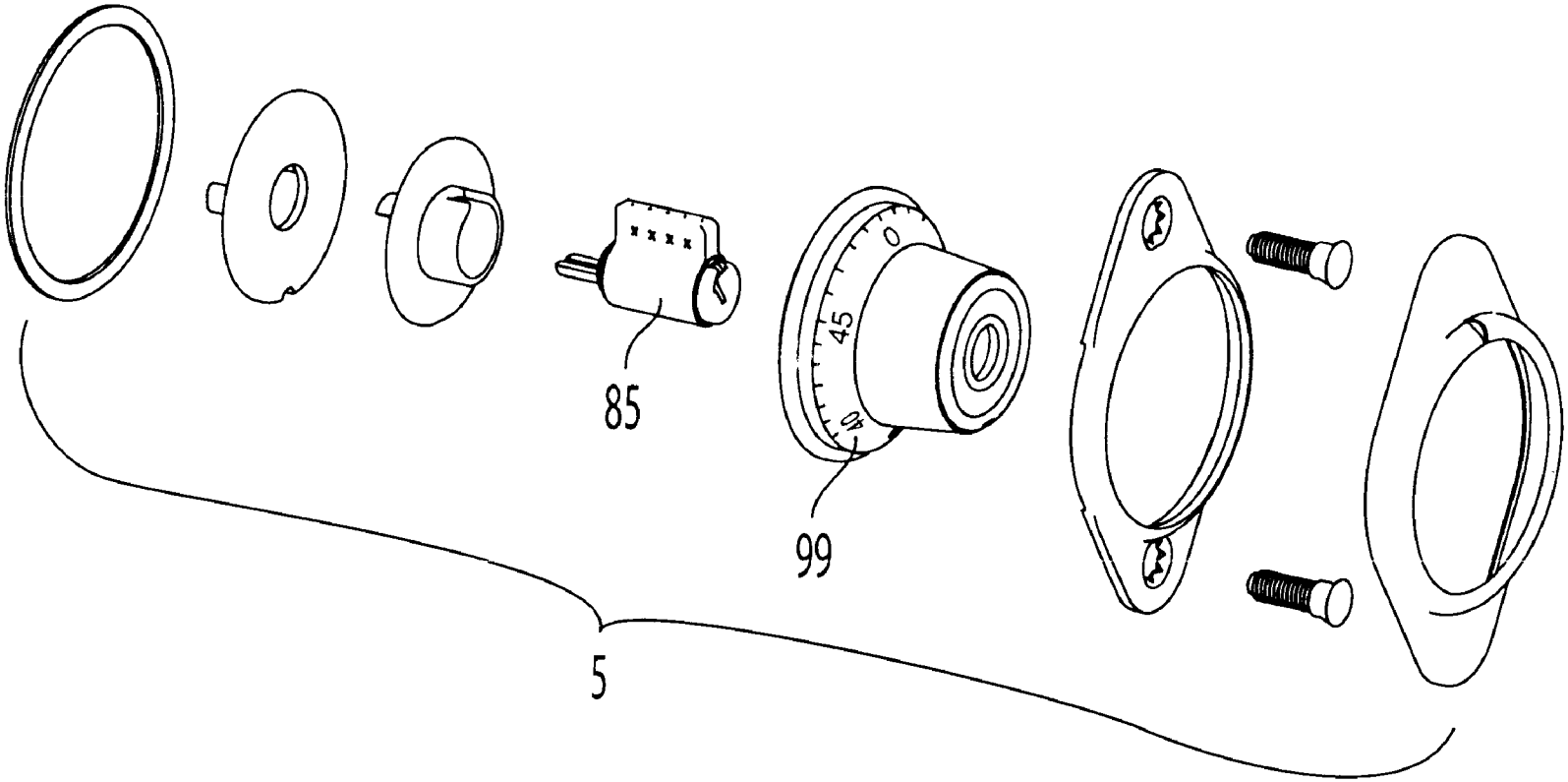
FIG. 4 is an exploded front perspective view of the dial assembly portion of the locker lock.
Figure 5:
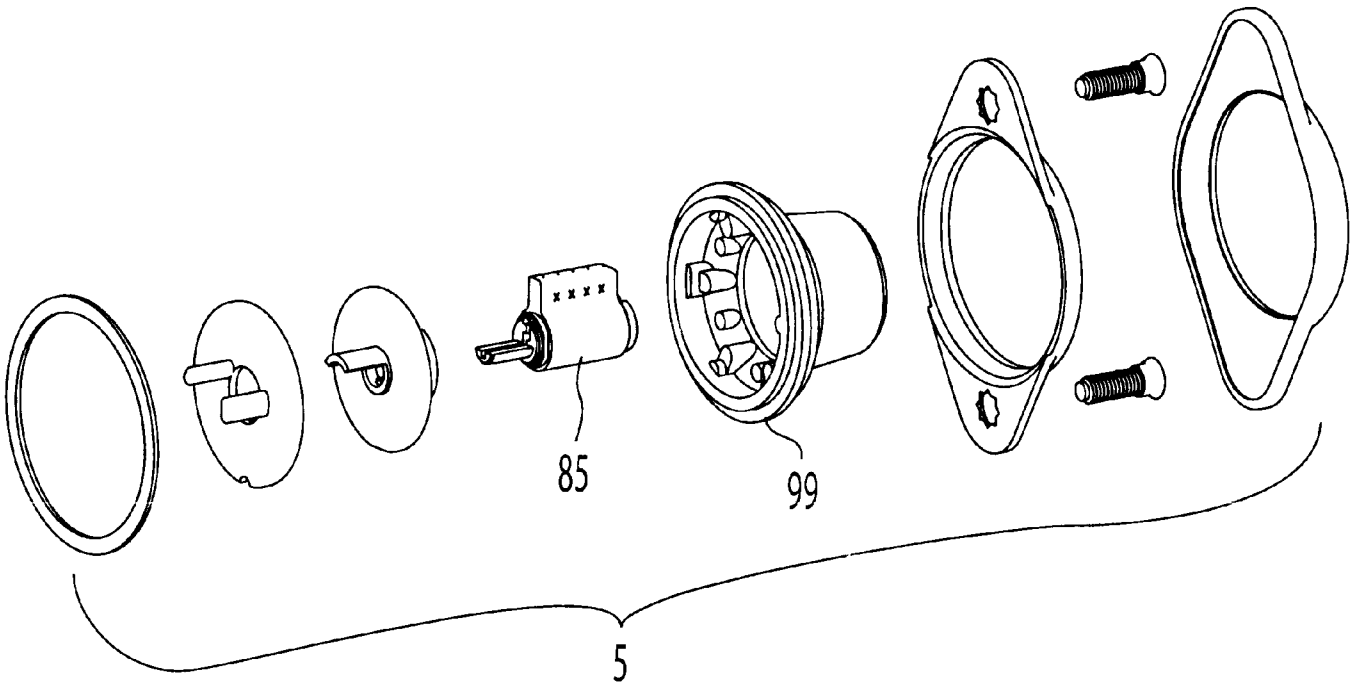
FIG. 5 is an exploded back perspective view of the dial assembly portion.

As is shown in FIG. 29, the bolt 15 is pushed to the retracted position, moving the arm 32 out of engagement with the flat area 83. The changing cam 81 is then rotated into contact with the distal end 79 of the shaft 78, moving the change disk 75 out of engagement with the wheel 47 containing the post 71 such that one of the notches 77 in the change disk moves out of engagement with the post. The change disk 75 is then rotated with respect to the wheel 47 to align a second one of the notches 77 in the change disk 75 with the post 71, and the change cam 81 is rotated back to its position shown in FIG. 28 to allow the changing cam 75 to again bias into contact with the wheel. A beveled surface 86 is provided on the change cam 81 to assist in engaging the distal end 79 of the shaft 79. As is shown in FIGS. 4 and 5, the dial assembly 5 includes a lock cylinder 85. When the dial assembly 5 is connect to the lock assembly 3 as shown in FIG. 1, the lock cylinder 85 engages the drive shaft 87 shown in FIGS. 2 and 3 that extends from the axis of rotation of the change cam through the backing plate and protrudes through an opening 88 in the cover plate 9.

Therefore, rotation of the lock cylinder 85 rotates the changing cam 81.

Figure 30:
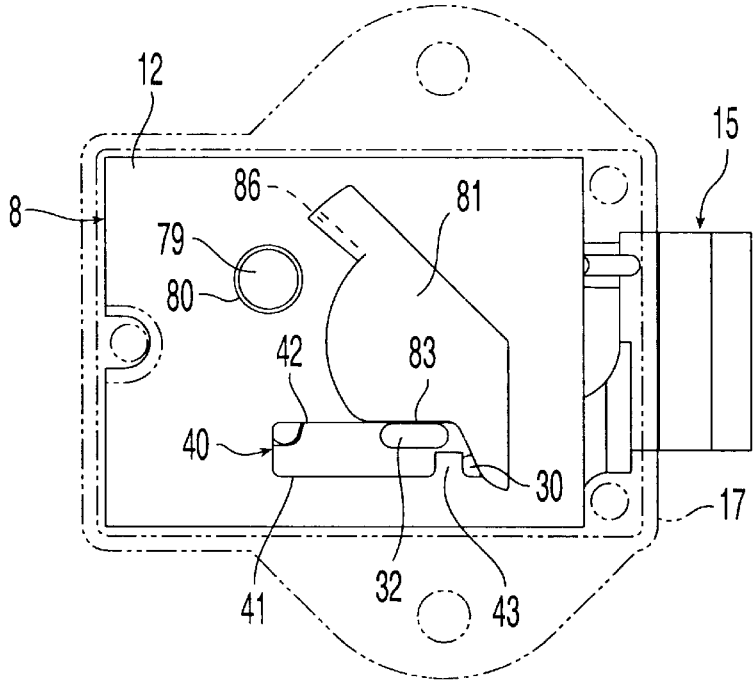
FIG. 30 is a side view of the side of the backing plate portion of the lock assembly with a changing cam attached thereto and the parts of the assembly in a third position of operation.
Figure 31:
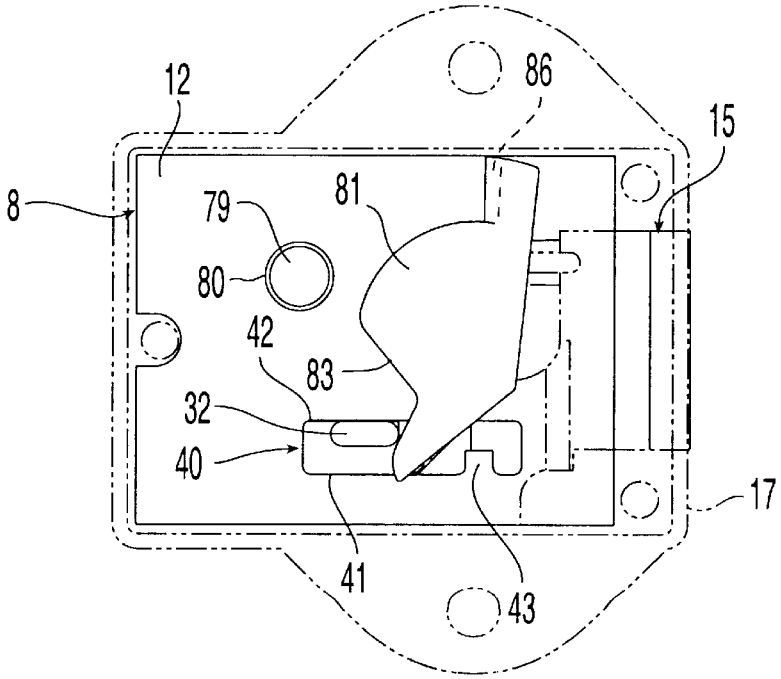
FIG. 31 is a side view of the side of the backing plate portion of the lock assembly with a changing cam attached thereto and the parts of the assembly in a fourth position of operation.

As is shown in FIG. 30, when the bolt is in the fully extended position, the arm 32 engages the flat area 83 on the changing cam 81 to prevent its rotation relative to the backing plate. The cross member 30 of the trigger, however, does not extend completely through the slot 40 so as to protrude from the second side 12 of the backing plate 8. When the lock cylinder 85 is turned so as to rotate the changing cam clockwise as shown in FIG. 31, the changing cam 81 engages the arm 32, moving the arm 32 and the slide plate 24 to which it is attached toward the rearward position, lifting the cross member away from the bottom surface 41 of the slot 40 and out of engagement with the from front surface 44 of the stop 43. The bolt is then moved to the retracted position. In this way, the lock cylinder can be used to move the bolt from the fully extended position to the retracted position without the use of the combination wheel pack 46.

As is shown in FIGS. 2, 3, 32, and 33, the lock assembly also includes a drive gear 95 and a pinion gear 97. The drive gear is positioned concentric with the axis of rotation of the changing cam 81 and an axis of rotation of both the lock cylinder and a numbered dial 99 in the dial assembly 5. The pinion gear 97 is positioned concentrically with the wheel pack 46 and the axis of rotation of the change disk 75. This positioning of the gears provides an offset of the combination wheel pack 46 in the case 7 from the dial assembly 3 to accommodate the bolt assembly 14.

The pinion gear 97 contains a plurality of gear teeth 101 and a non-circular central hole 103 having a plurality of radially extending grooves 104. The change disk 75 includes a plurality of splines 105, typically two, disposed on a side of the change disk 75 opposite the shaft 78. The splines 105 are grouped in pairs so that each pair has a first spline A extending radially outward from the center of the change disk 73 and a second spline B extending radially outward from the center in an opposite direction from the first spline A. The radially extending grooves 104 are arranged to correspond to the arrangement of the splines 105. The drive gear 95 has twenty-five gear teeth 106, for example zero through twenty four. The drive and pinion gears are positioned adjacent each other so that one of the drive gear teeth 106 is completely engaged between two of the pinion gear teeth 101. When the dial assembly 5 and lock assembly 3 are connected, the dial 99 non-rotatably engages the drive gear 95.

Figure 32:
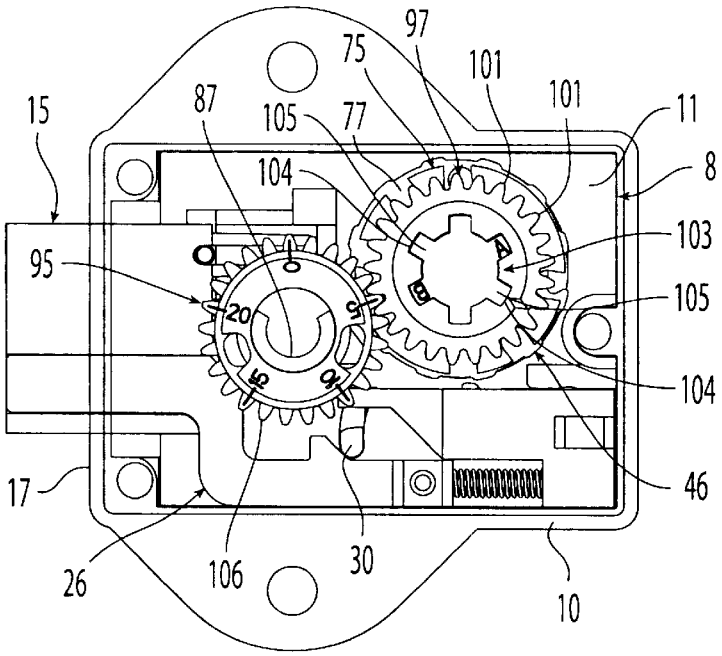
FIG. 32 is a side view of the front of the lock assembly portion with the cover plate removed and the parts of the assembly positioned in a first alignment.
Figure 33:
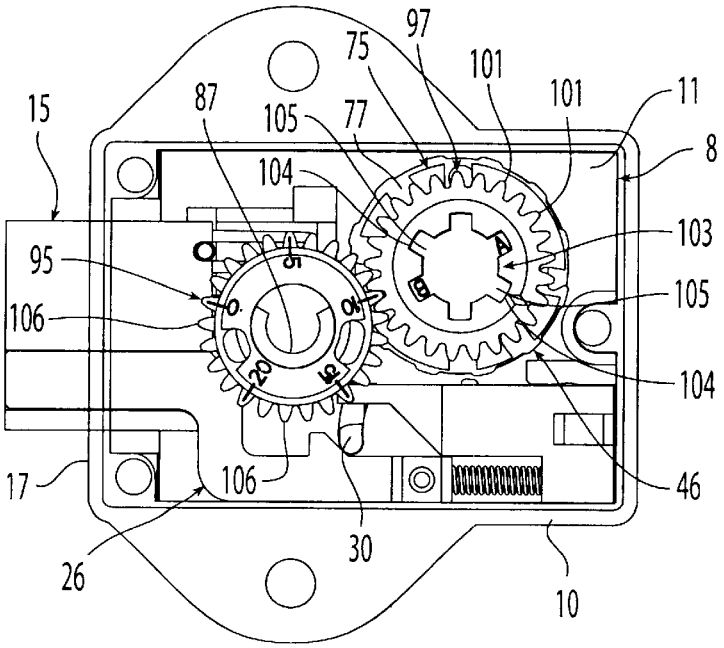
FIG. 33 is a side view of the front of the lock assembly portion with the cover plate removed and the parts of the assembly positioned in a second alignment.

As is shown in FIG. 1, the dial 99 contains fifty numbers, for example zero through forty nine. Therefore, each of the digits in the three digit combination of the lock, 1 can be assigned a value from zero to forty nine. Given a selection arrangement of the wheels 47 in the wheel pack 46, assigning a value to just one of the three digits determines the other two because the relative spacing between the numbers is fixed by the selection arrangement. As is shown in FIGS. 32 and 33, and initial alignment among the change disk 75, pinion gear 97, and drive gear 95 assigns one of the fifty numbers from the dial 99 to each of the six notches in the change disk 75. Engagement of the post 71 extending from one of wheels in the wheel pack into one of the six notches, selects one of the six assigned numbers as the third digit in the three digit combination, which in turn determines the other two digits. Therefore, for a given initial arrangement among the change disk 75, pinion gear 97, and drive gear 95, six different three digit combinations are available. Moving the post 71 from notch to notch changes the current combination of the lock 1.

Because the splines 105 of the change disk 75 are arranged in pairs with each pair being symmetric about the center of the change disk, and the central hole 103 and grooves 104 of the pinion gear 97 are arranged to correspond to the spline 105 arrangement, the change disk 75 and pinion gear 97 can be aligned and engaged in a number of positions equal to the number of splines. An initial positioning between the drive gear 95 and the pinion gear 97 can place any one of the twenty-five drive gear teeth 106 between two of the pinion gear teeth 101, for example drive gear tooth number 5 as shown in FIG. 32 or drive gear tooth number 10 as shown in FIG. 33. Therefore, with two splines 105 and twenty five drive gear teeth 106, fifty different initial arrangements among the change disk 75, pinion gear 97, and drive gear 95 are possible. All fifty arrangements are provided by mechanisms internal to the lock assembly 3 as opposed to using mechanisms in both the lock and the dial assemblies. Thus, only one dial assembly 5 is needed, simplifying manufacturing of the lock and reducing costs.

Figure 34:
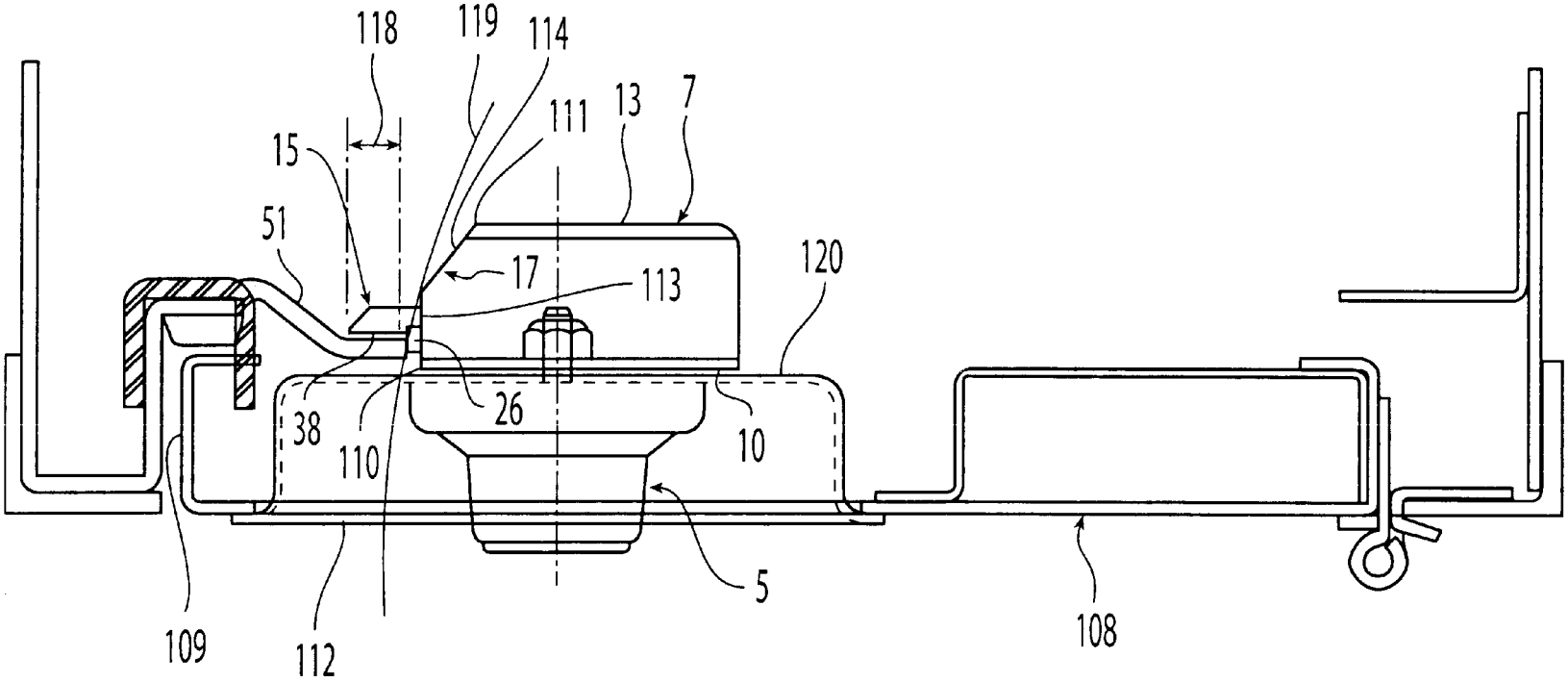
FIG. 34 is a view from the top of a pocketed locker door showing the lock with the bolt in the fully extended position.
Figure 35:
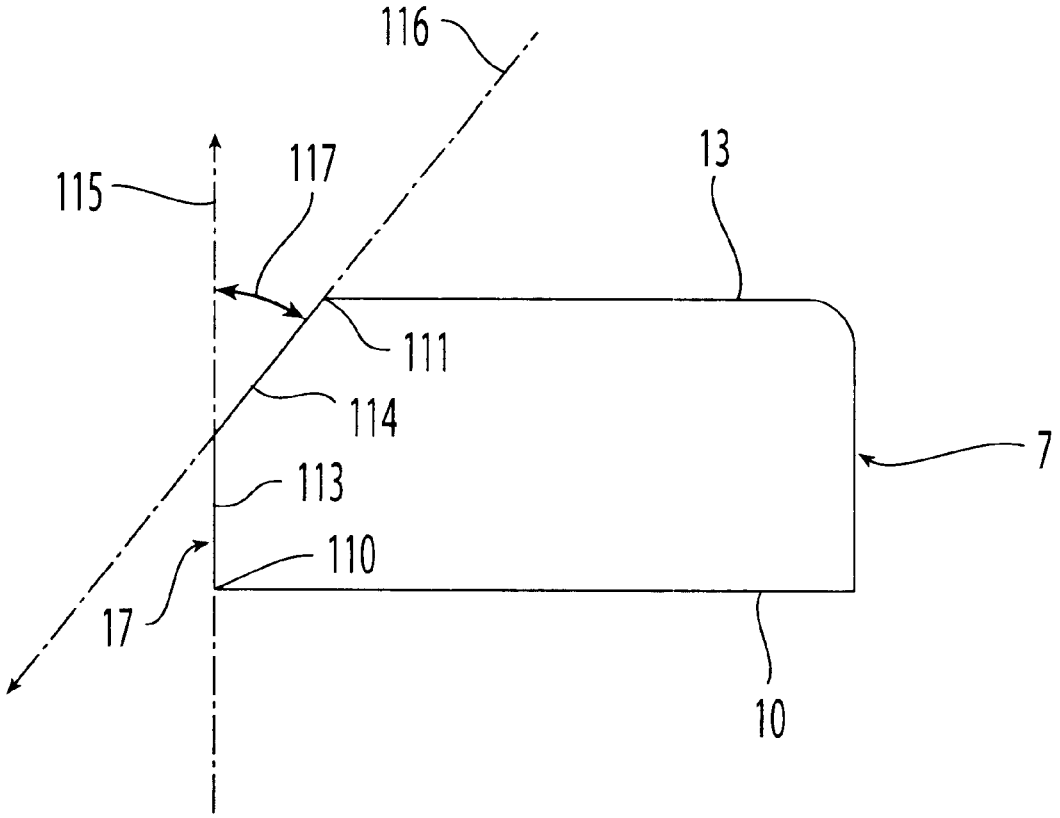
FIG. 35 is a top view of the case portion of the lock assembly.

As is best shown in FIG. 34, the lock 1 is mounted to a locker door 108 such that the door 108 is located between the lock assembly 3 and the dial assembly 5. The front 10 of the case is in contact with the door 108, and the back 13 of the case 7 is located in the interior of the locker. The side 17 of the case 7 faces the door edge 109, intersects the front 10 of the case 7 at a front corner 110 and the back 13 of the case 7 at a back corner 111. The back corner 111 is set back from the door edge 109 in a direction parallel to the front of the door 112 farther that the front corner 110. The side 17 of the case intersects the front 10 of the case 7 at an angle of about 90°. As is shown in FIG. 35, the side includes a first portion 113 extending from the front corner 110 along a first direction 115 that is perpendicular to both the front 10 and the back 13 of the case 7, and a second, tapered portion 114 extending from the back corner 111 to the first portion 113 along a second direction 116. The second direction 116 intersects the first direction 115 at an angle 117 which is greater than about 0° and less that about 90°. Suitable shapes for the tapered portion 114 include a beveled edge, a curved radius, and a stepped shaped face. As shown in FIG. 34, the tapered portion 114 permits the lock 1 to be positioned as close as possible to the door edge 109 and the door strike 51, which in turn maximizes the length of engagement 118 between the flat face 38 of the bolt 15 the door strike 51 by compensating for the swing arc 119 of the case 7 past the strike 51. This provides added security especially in lockers having narrow doors, or pockets 120 in which the lock is disposed, as these doors create more sharply curved swing arcs.

What is claimed is:

1. A locker lock comprising:

a case having a slot disposed therein, the slot having first and second sides; a stop extending partially into the slot from the first side thereof, the stop having front and back surfaces;

a bolt extensible with respect to the case and being movable among a retracted position, a partially extended position, and a fully extended position; and a trigger biased into engagement with a first side of the slot and extending from the slot to engage the bolt, said trigger having a first position in which the trigger engages the front surface of the stop preventing movement of the bolt when the bolt is in the fully extended position, and a second position in which the trigger is biased into engagement with the back surface of the stop preventing movement of the bolt from advancing to the fully extended position when the bolt is in the partially extended position.

2. The locker lock of claim 1, which further comprises a bolt assembly that is slideably disposed within the case and which receives the-bolt therein, the bolt assembly comprising:

a slide plate having a slide plate cam surface, the slide plate in contact with the bolt and capable of relative movement with respect to the bolt between a forward position and a rearward position;

wherein, when the slide plate is in said forward position, the bolt is in the fully extended position and the trigger is in contact with said first side of said slot and said front surface of said stop, and when the slide plate moves relative to the bolt from the forward position toward the rearward position the trigger contacts the slide plate cam surface and is lifted away from said first side of said slot a sufficient distance to move the trigger out of engagement with said front surface of said stop such that the bolt is permitted to move from the fully extended position toward the retracted position.

3. The locker lock of claim 1, which further comprises a bolt assembly that is slidably disposed within the case and which receives the bolt therein, the bolt assembly comprising:

a plunger having a plunger cam surface, the plunger in contact with the bolt and capable of relative movement with respect to the bolt between an outward position and an inward position; wherein then the plunger is in the outward position, the bolt is in the partially extended position and the trigger is in contact with said first side of said slot and said back surface of said stop, and when the plunger moves relative to the bolt from the outward position toward the inward position, the trigger contacts the plunger cam surface and is lifted away from said first side of said slot a sufficient distance to move the trigger out of engagement with said back surface of said stop such that the bolt is permitted to move from the partially extended position to the fully extended position.

4. The locker lock of claim 3, wherein:

the plunger further comprises a plunger stop surface adjacent the plunger cam surface; and, when the plunger is in the inward position and the trigger is in contact with said first side of said slot, the trigger engages the plunger stop surface to hold the plunger in the inward position.

5. The locker lock of claim 4, wherein the bolt assembly further comprises:

a slide plate having a slide plate cam surface, the slide plate is in contact with the bolt and capable of relative movement with respect to the bolt between a forward position and a rearward position;

wherein when the slide plate is in said forward position, the bolt is in the fully extended position and the trigger is in contact with said first side of said slot and said front surface of said stop, and when the slide plate moves relative to the bolt from the forward position toward the rearward position the trigger contacts the slide plate cam surface and is lifted away from said first side of said slot a sufficient distance to move the trigger:

out of engagement with said front surface of said stop such that the bolt is permitted to move from the fully extended position toward the retracted position; and, out of engagement with the plunger stop surface to permit the plunger to move from the inward to the outward position.

6. The locker lock of claim 1, wherein:

the case comprises:

a front;

a back opposite the front; and, a side extending between the front and the back, intersecting the front at a front corner, and intersecting the back at a back corner;

wherein, when the locker lock is mounted on a door with the front of the case in contact with the door and the side of the case disposed facing the door edge, the back corner of the case is set back from the door edge farther than the front corner of the case.

7. The locker lock of claim 6, wherein the side intersects the front of the case at an angle of about 90°.

8. The locker lock of claim 7, wherein the side further comprises:

a first portion extending from the front corner along a first direction that is perpendicular to both the front and back of the case; and a second portion extending from the back corner to the first portion along a second direction, the second direction intersecting the first direction at an angle greater than about 0° and less than about 90°.

9. A locker lock comprising:

a case having a backing plate mounted therein, the backing plate having a first side and a second side opposite the first side;

a combination wheel pack comprising a plurality of concentric wheels rotatably mounted on the first side of the backing plate;

a post extending from one of the wheels in the wheel pack;

a change disk having a plurality of notches and biased onto engagement with the wheel containing the post such that the post engages in a first one of said plurality of notches;

a shaft extending from the change disk, axially through the plurality of wheels, and through a hole in the backing plate such that the distal end of the shaft is disposed on the second side of the backing plate, the change disk being rotatable about the shaft and the engagement of the post in the first one of said plurality of notches preventing rotation of the change disk relative to the wheel containing the post; and a changing cam rotatably mounted on the second side of the backing plate;

wherein, when the changing cam is rotated into engagement with the distal end of the shaft, the shaft is pushed toward the change disk and moving the change disk out of engagement with the wheel containing the post such that the post disengages from the first one of the plurality of notches, allowing the change disk to rotate about the shaft relative to the wheel containing the post to align the post with a second one of the plurality of notches so that upon disengagement of the change cam with the distal end of the shaft, the change disk is biased back into engagement with the wheel containing the post and the post engages in the second one of the plurality of notches.

10. The locker lock of claim 9, wherein:

the combination wheel pack contains three wheels; and the change disk contains six notches.

11. The locker lock of claim 9, which further comprises:

a bolt disposed adjacent the backing plate and movable with respect to both the backing plate and the case between retracted and extended positions, the bolt comprising:

an arm, extending from the bolt such that when the bolt is in the extended position the arm engages the changing cam to prevent rotation of the changing cam into engagement with the distal end of the shaft, and when the bolt is in the retracted position, the arm does not engage the changing cam, permitting the changing cam to rotate into engagement with the distal end of the shaft.

12. The locker lock of claim 11, wherein:

the bolt is disposed adjacent the first side of the backing plate;

the backing plate includes a slot passing completely through the backing plate from the first side to the second side; and the arm extends from the bolt through the slot to engage the changing cam.

13. The locker lock of claim 12, wherein:

the changing cam is rotated in a first direction to engage the distal end of the shaft; and when the bolt is in the extended position and the changing cam is rotated in a second direction opposite the first direction, the changing cam engages the arm to move the bolt from the extended position to the retracted position.

14. The locker lock of claim 9, wherein:

the change disk further comprises a plurality of splines grouped in pairs, each pair having:

a first spline extending radially outward from a center of the change disk; and a second spline extending radially outward from the center in an opposite direction from the first spline; and the locker lock further comprises:

a pinion gear disposed within the case and concentric with and non-rotatably attached to the change disk, the pinion gear having:

a non-circular central hole having a plurality of radial grooves group in pairs and arranged to correspond to the pairs of splines such that the pinion gear and the change disk can be rotatably aligned with respect to one another about the center of the change disk axis in a number of positions equal to the number of splines; and a plurality of pinion gear teeth; and a drive gear disposed within the case and having a plurality of drive gear teeth, the drive gear teeth engaging the pinion gear teeth;

wherein an initial alignment among the change disk, pinion gear, and drive gear is determined by the rotational alignment between the change disk and the pinion gear and the positioning of one of the plurality of drive gear teeth into engagement with the pinion gear teeth, and a number of possible initial alignments is equal to the number of drive gear teeth multiplied by the number of splines.

15. The locker lock of claim 14, wherein:

the change disk contains two splines;

the drive gear contains twenty five drive gear teeth; and the number of possible initial alignments among the change disk, pinion gear, and drive gear equals fifty.

16. The locker lock of claim 15, wherein:

the combination wheel pack contains three wheels;

the change disk contains six notches; and the locker lock further comprises a lock dial non-rotatably connected to the drive gear and containing fifty numbers;

wherein the locker lock is a three digit combination type lock, the spacing among the three digits in the combination is set by the three wheels such that selection of any one of the three digits determines the other two, and the initial alignment among the drive gear, pinion gear and change disk determines which six numbers from the dial correspond to the six notches in the change disk thereby setting one of the digits in the three digit combination and determining six possible three digit combinations for the locker lock.

17. The locker lock of claim 1, wherein said trigger is pivotally mounted on said bolt.

* * * * *